United States Patent [19]

Corsello

[11] Patent Number: 4,910,955

[45] Date of Patent: Mar. 27, 1990

[54] HORSESHOE TRIMMING DEVICE

[76] Inventor: Thomas G. Corsello, 5060 Cedar Ravine Rd., Placerville, El Dorado, Calif. 95667

[21] Appl. No.: 261,149

[22] Filed: Oct. 24, 1988

[51] Int. Cl.[4] ..... B21K 15/02

[52] U.S. Cl. ..... 59/59; 59/60; 29/560.1; 83/694

[58] Field of Search ..... 59/37, 59, 40, 41, 44, 59/45, 46, 49, 50, 60, 56, 57, 58; 83/633, 641, 694; 72/478, 477; 29/560, 560.1

[56] References Cited

U.S. PATENT DOCUMENTS

| | | | |
|---|---|---|---|
| 50,756 | 10/1865 | Weimer | 72/471 |
| 265,705 | 10/1882 | Roe | 59/59 |
| 320,349 | 6/1885 | Greenwood | 59/59 |
| 354,236 | 12/1886 | Richards | 72/477 |
| 490,734 | 1/1893 | Benfield | 59/60 |
| 1,361,311 | 12/1920 | De La Pena | 72/477 |
| 1,479,728 | 1/1924 | Merklinger et al. | 59/60 |
| 3,874,165 | 4/1975 | Dawson | 59/56 |
| 3,917,000 | 11/1975 | Spencer | 168/4 |
| 4,116,278 | 9/1978 | Spencer | 168/4 |
| 4,573,339 | 3/1986 | Emery | 72/384 |
| 4,585,068 | 4/1986 | Jungersen | 168/11 |

*Primary Examiner*—David Jones

*Attorney, Agent, or Firm*—Jerry T. Kearns

[57] ABSTRACT

A horseshoe trimming device for securement to a farrier's anvil has a base provided with a downwardly extending rectangular post dimensioned for insertion into a rectangular socket on the farrier's anvil. A clamp screw clamps a portion of the anvil against the rectangular post. An anvil plate is secured to an adjustment plate which is pivotally mounted on an upper surface of the base. Opposed set screws bear against opposite side edges of the adjustment plate for adjusting the attached anvil plate in opposite rotational directions. By tightening a pivotal mounting bolt extending through the adjustment plate, the attached anvil plate may be secured in a selected adjusted position. The anvil plate has an arcuate edge dimensioned for cooperation with the arcuate cutting edge of a shear blade to trim end portions of a horseshoe. The arcuate shear blade has an elongated rectangular shank received within a rectangular guide tube for vertical reciprocal movement. Two perpendicular set screws extend through perpendicular side walls of the guide tube and abut perpendicular side faces of the rectangular shank to adjust the clearance of the rectangular shank with the guide tube. An adjustable stop screw is provided for positioning a horseshoe in proper alignment on the anvil plate. The arcuate shear blade is actuated by a manually moved handle through a compound pivotal linkage.

20 Claims, 9 Drawing Sheets

HORSESHOE TRIMMING DEVICE

BACKGROUND OF THE INVENTION

1. Field of the Invention

The present invention relates to horseshoe trimming devices, and more particularly pertains to a new and improved horseshoe trimming device adapted for securement to a conventional farrier's anvil. In order to properly shoe a horse, a farrier must conform a horseshoe blank to the particular configuration of the horse's hoof. Conventionally, the horseshoe blank is heated and hammered against an anvil to bend the shoe to the desired configuration. Because it is difficult for horse owners to transport horses, it is the common practice for the farrier to travel, with the necessary tools and equipment, to the location of the horse to be shod. Thus, the amount and weight of the farrier's equipment is limited to that which may be conveniently and efficiently transported. This has in the past limited the use of hydraulic presses and shears for the in situ forming of horseshoe blanks to the desired configuration. In the conventional method of trimming the arcuate free ends of a generally U-shaped horseshoe blank to the desired length, a rectangular shank having a sharpened upper end cutting edge is inserted into a rectangular socket conventionally provided in a farrier's anvil. The horseshoe blank is then heated and held against the sharpened edge by suitable pliers or tongs. The farrier then repeatedly strikes the horseshoe blank with a hammer to trim the horseshoe ends to the desired length. This operation requires a great deal of physical strength and a large amount of skill and craftsmanship. Additionally, the operation is fatiguing to the farrier as well as being inordinately time consuming. In order to overcome this problem, the present invention provides a device for trimming the arcuate free ends of a U-shaped horseshoe blank which utilizes a compound pivotal linkage to actuate a shear blade with a minimum of effort.

DESCRIPTION OF THE PRIOR ART

Various types of devices for shaping horseshoes are known in the prior art. A typical example of such a device is to be found in U.S. Pat. No. 3,874,165, which issued to W. Dawson on April 1, 1975. This patent discloses a device for shaping prefabricated horseshoe blanks to fit a particular horse's hoof which includes a base, a toe clamp attached to the base for holding the shoe in place, and bending elements eccentrically mountable in the base on the inside and outside of the shoe. U.S. Pat. No. 3,917,000, which issued to D. Spencer on Nov. 4, 1975, discloses a horseshoe assembly which includes a shoe element having a bottom member with adhesive means applied thereto. Elongated strands ar threaded through holes in the horse's hoof for direct contact with the adhesive to facilitate the adhesion of the shoe to the hoof. U.S. Pat. No. 4,116,28, which issued to D. Spencer on Sept. 26, 1978, discloses a horseshoe having a generally U-shaped body member and a pair of free ends. An upstanding projection is mounted on the upper surface at each free end for fitting in corresponding pockets in the horse's hoof. A band spans the free ends of the horseshoe to restrain the outward spreading thereof. U.S. Pat. No. 4,573,339, which issued to L. Emery on Mar. 4, 1986, discloses a tool having two elongate members journaled at a central point. Each of the elongate members has certain plugs and flanges which can be brought to bear upon a horseshoe positioned within the tool, such that the shape of the horseshoe can be modified in the way typically needed by a farrier in shaping a horseshoe to precisely fit the hoof of a horse to be shod. U.S. Pat. No. 4,585,068, which issued to A. Jungrrsen on April 29, 1986, discloses a two part horseshoe consisting of a channel shaped upper part to be nailed to the horse's hoof and an exchangeable lower part formed from an elastic material and having a ridge member that can be pressed into the channel of the upper part.

While the above mentioned devices are suited for their intended usage, none of these devices disclose an easily portable shear adapted for attachment to a conventional farrier's anvil and utilizing a compound pivotal linkage to drive an arcuate shear blade against the arcuate edge of an aligned anvil plate to trim the arcuate free end of a horseshoe blank. Additionally, none of the aforesaid devices disclose the provision of a horseshoe trimming device having a rectangular mounting post dimensioned for insertion into the standard rectangular socket provided on a conventional farrier's anvil and provided with a camping mechanism for clamping a portion of the anvil against the mounting post. Additional features of the present invention, not disclosed by the aforesaid prior art devices, include the provision of a pivotally adjustable arcuate anvil plate, a mechanism for adjusting an elongated shank of the shear blade in two perpendicular directions and the use of an adjustable stop to align a horseshoe blank in a correct position on the arcuate anvil plate. Inasmuch as the art is relatively crowded with respect to these various types of horseshoe trimming devices, it can be appreciated that there is a continuing need for and interest in improvements to such horseshoe trimming devices, and in this respect, the present invention addresses this need and interest.

SUMMARY OF THE INVENTION

In view of the foregoing disadvantages inherent in the known types of horseshoe trimming devices now present in the prior art, the present invention provides an improved horseshoe trimming device. As much, the general purpose of the present invention, which will be described subsequently in greater detail, is to provide a new and improved horseshoe trimming device which has all the advantages of the prior art horseshoe trimming devices and none of the disadvantages.

To attain this, a representative embodiment of the concepts of the present invention is illustrated in the drawings and makes use of a base provided with a downwardly extending rectangular post dimensioned for insertion into a rectangular socket on a farrier's anvil. A clamp screw clamps a portion of the anvil against the rectangular post. An anvil plate is secured to an adjustment plate which is pivotally mounted on an upper surface of the base. Opposed set screws bear against opposite side edges of the adjustment plate for adjusting the attached anvil plate in opposite rotational directions. By tightening a pivotal mounting bolt extending through the adjustment plate, the attached anvil plate may be secured in a selected adjusted position. The anvil plate has an arcuate edge dimensioned for cooperation with the arcuate cutting edge of a shear blade to trim end portions of a horseshoe. The arcuate shear blade has an elongated rectangular shank received within a rectangular guide tube for vertical reciprocal movement. Two perpendicular set screws extend through perpendicular side walls of the guide tube and abut perpendicular side faces of the rectangular shank to adjust the clearance of the rectangular shank with the guide tube. An adjustable stop screw is provided for positioning a horseshoe in proper alignment on the anvil plate. The arcuate shear blade is actuated by a manually moved handle through a compound pivotal linkage.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved horseshoe trimming device which has all the advantages of the prior art horseshoe trimming devices and none of the disadvantages.

It is another object of the present invention to provide a new and improved horseshoe trimming device which may be easily and efficiently manufactured and marketed.

It is a further object of the present invention to provide a new and improved horseshoe trimming device which is of a durable and reliable construction.

An even further object of the present invention is to provide a new and improved horseshoe trimming device which is susceptible of a low cost of manufacture with regard to both materials and labor, and which accordingly is then susceptible of low prices of sale to the consuming public, thereby making such horseshoe trimming devices economically available to the buying public.

Still yet another object of the present invention is to provide a new and improved horseshoe trimming device which provides in the apparatuses and methods of the prior art some of the advantages thereof, while simultaneously overcoming some of the disadvantages normally associated therewith.

Still another object of the present invention is to provide a new and improved horseshoe trimming device adapted for detachable mounting to a conventional farrier's anvil.

Yet another object of the present invention is to provide a new and improved horseshoe trimming device which utilizes a compound pivotal linkage to drive a shear blade to efficiently trim arcuate free end portions of a horseshoe blank.

Even still another object of the present invention is to provide a new and improved horseshoe trimming device having an adjustably mounted arcuate anvil plate configured for precise alignment with the arcuate edge of a reciprocal shear blade.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
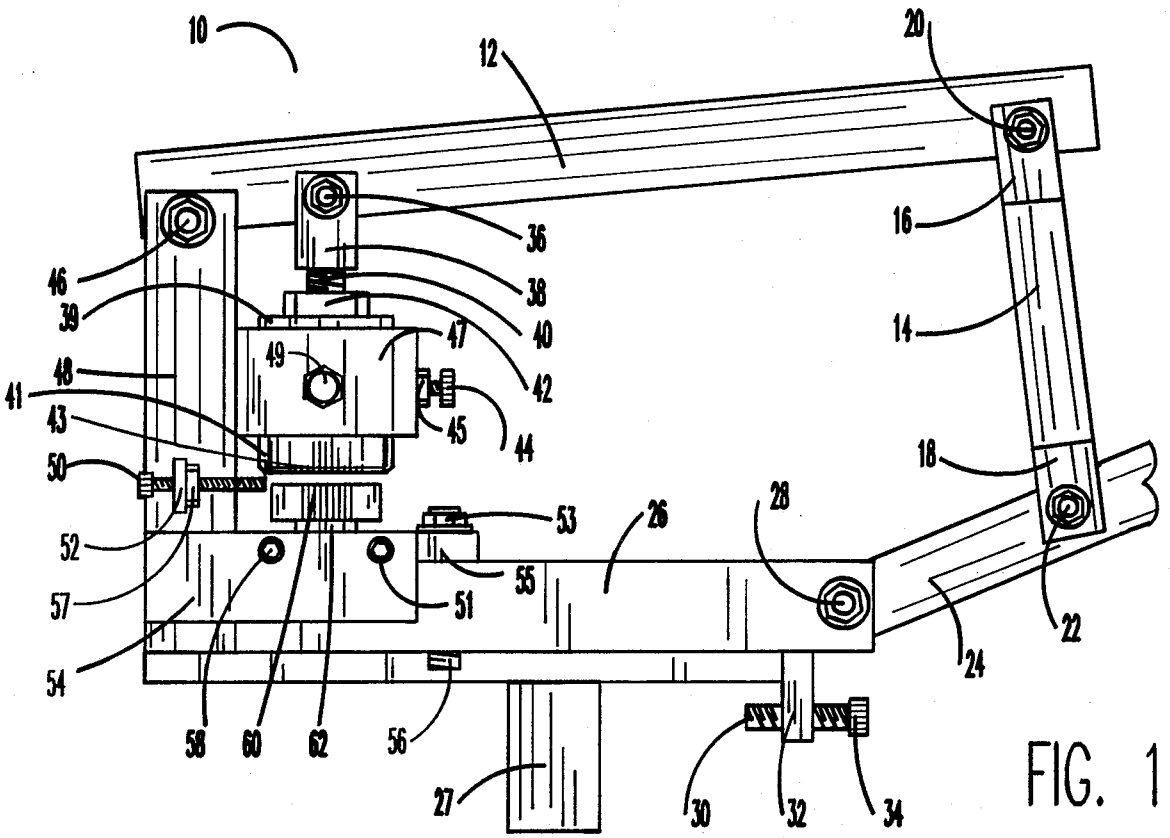
FIG. 1 is a side view of the horseshoe trimming device of the present invention.

With reference now to the drawings, and in particular to FIG. 1 thereof, a new and improved horseshoe trimming device embodying the principles and concepts of the present invention and generally designated by the reference numeral 10 will be described.

More specifically, it will be noted that the first embodiment 10 of the invention includes a base 26 which is formed by an elongated rectangular steel bar. A rectangular mounting pOSt 27 extends perpendicular downwardly from a bottom surface of the base 26 and is dimensioned for insertion into a rectangular socket conventionally provided on a farrier's anvil. A clamp screw 30 is received through a threaded aperture in a downwardly extending tab 32 secured to the bottom surface of the base 26. The clamping screw 30 has a hexagonal socket head 3 for rotating the clamp screw 30 to engage a side edge of a farrier's anvil. Through this arrangement, a portion of the anvil may be clamped between the mounting post 27 and the clamp screw 30. An adjustment plate 55 in the form of a short rectangular steel plate is pivotally mounted on a threaded stud 56 extending through the base 26. By loosening the nut 53 on the upper portion of the stud 56, the adjustment plate 55 may be pivotally adjusted. After adjustment, by retightening the nut 53, the plate 55 may be secured in the desired adjusted position. Hexagonal socket headed set screws 51 and 58 extend transversely through a rectangular side wall portion 54 secured to the base 26 and have inner ends which bear against the side wall of the adjustment plate 55. Thus, with the nut 53 in a loosened condition, the set screws 51 and 58 may be adjusted to pivot the plate 55 in a first rotational direction. By similar manipulation of set screws provided on an opposite side of the base 26, the plate 55 may be pivoted in an opposite rotational direction. An anvil plate 60 has a shank portion 62 which is secured to the plate 55. Thus, the anvil plate 60 is mounted for pivotal movement with the plate 55. A vertically extending support standard 48 is secured adjacent one end of the base 26 and includes an outwardly extending tab 52 having a threaded aperture receiving a threaded stop screw 50. A jam nut 57 is provided for securing the stop screw 50 in a selected adjusted position. The stop screw 50 is utilized to position a horseshoe blank in a proper alignment on the upper surface of the anvil plate 60. The support standard 48 is in the form of a rectangular steel bar having a slotted upper end portion forming a bifurcated yoke which receives an end portion of a first pivotal link 12. A pivot bolt 46 extends through an aperture in the pivotal link 12, thus mounting the link 12 for pivotal movement about the axis of the bolt 46. A connecting yoke 38 has a slotted bifurcated upper end portion which receives the pivot link 12. A pivot bolt 36 pivotally secures the connecting link 38 to the pivotal link 12. A threaded stud 40 extends downwardly from a lower end of the connecting link 38 and is received within a threaded aperture formed in an upper end of an elongated rectangular shank 39. A nut 42 secures the shank 39 and the threaded stud 40 is a selected adjusted position. This connection allows the shank 39 to be adjusted with respect to the link 38, to compensate for wear of the shear blade 41. A rectangular hollow guide tube member 47 is secured to the support standard 48 and receives the rectangular shank 39 with a slight clearance therein. Set screws 49 and 44 extend through perpendicular side faces of the rectangular guide tube 47 and have inner ends which bear against perpendicular side faces of tee rectangular shank 39 to adjust the clearance between the shank 39 and the interior walls of the guide tube 47 in two perpendicular directions. Jam nuts 45 are provided to secure the set screws 44 and 49 in a selected adjusted position. An arcuate shear blade 41 is secured to a lower end of the rectangular shank 39 and is provided with a sharpened or beveled arcuate cutting edge 43, which is aligned with a complementary configured top edge of the anvil plate 60. Thus, a horseshoe blank overlying the anvil plate 60 may have a free end trimmed to the correct length, while maintaining the proper arcuate curvature, by downwardly urging the shear blade 41. In order to drive the shear blade 41 downwardly with sufficient force, a compound pivotal linkage is provided, which includes the top link 12 and a second intermediate link 14 extending between the top link 12 and an elongated handle 24. The intermediate link 14 has opposite bifurcated slotted end portions 16 and 18 secured by respective pivot bolts 20 and 22. The handle 24 has a first end pivotally mounted by a pivot bolt 28 within a slot formed at one end of the base 26. The opposite end of the handle 24 has been cut away, but is formed with a sufficient length to provide the required mechanical advantage to drive the shear blade 41.

Figure 2:
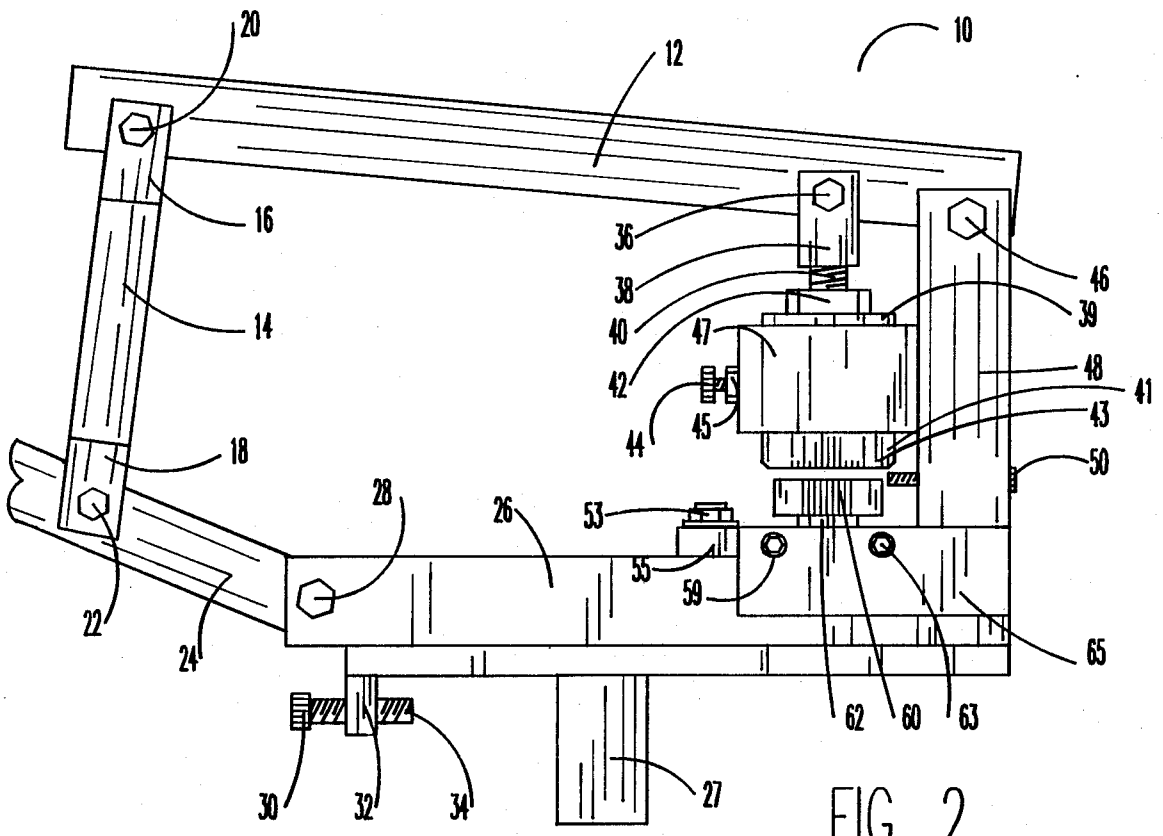
FIG. 2 is an opposite side view of the horseshoe trimming device of the present invention.

FIG. 2 provides an opposite side view of the horseshoe trimming device 10, which illustrates the opposite side wall portion 65 secured to the base 26 and including hexagonal socket headed set screws 59 and 63 for urging the pivotal adjustment plate 55 in the opposite rotational direction. The curved radiused tip portion of the anvil plate 60 is illustrated in alignment with the arcuate cutting shear blade 41.

Figure 3:
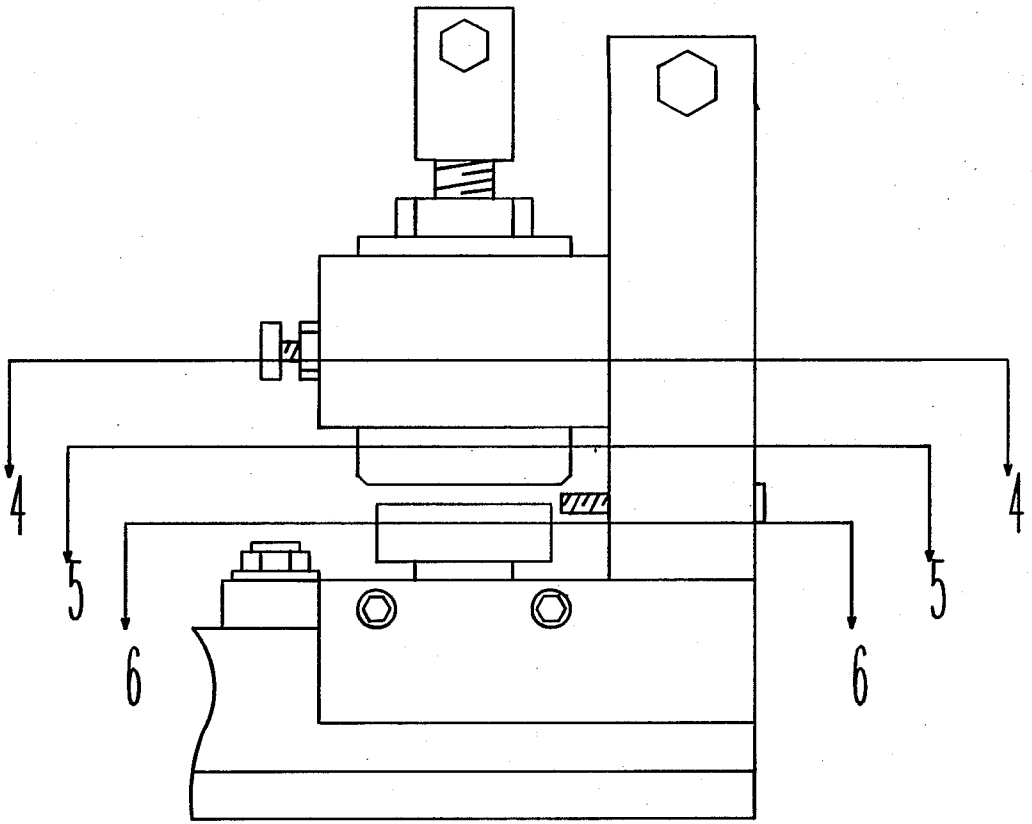
FIG. 3 is a partial side view of the horseshoe trimming device of the present invention, illustrating the cross sectional planes of the subsequent figures.

FIG. 3 provides an enlarged partially cut away view of the horseshoe trimming device of the present invention, with the pivotal linkage removed therefrom. FIG. 3 illustrates the planes of the transverse cross sectional views of FIGS. 4, 5 and 6.

Figure 4:
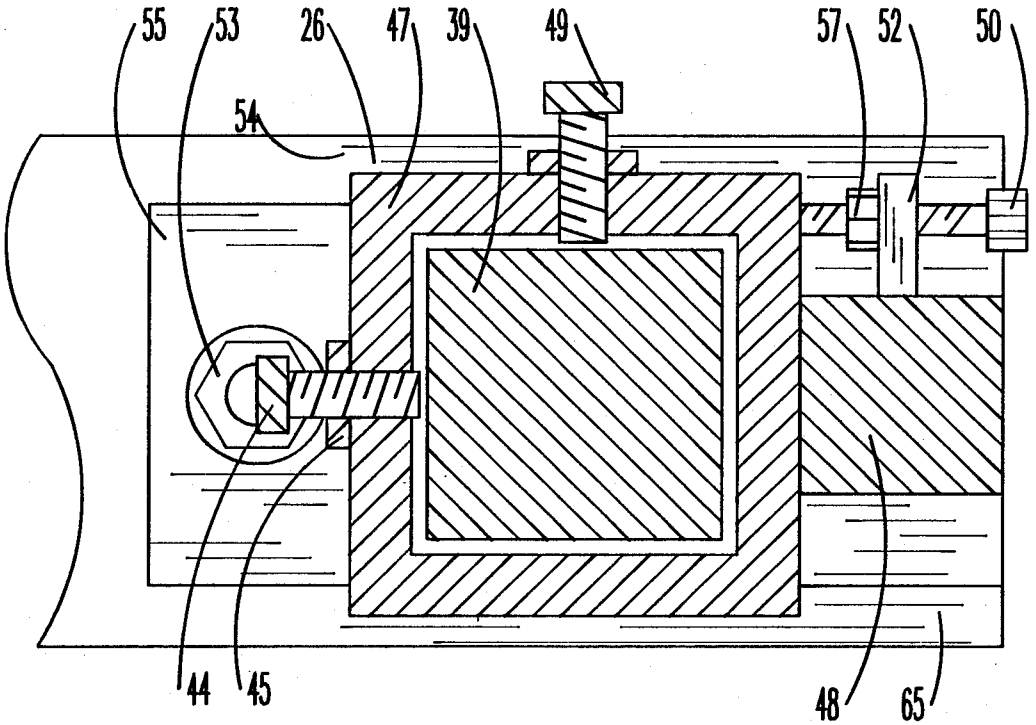
FIG. 4 is a transverse cross sectional view, taken along line 4—4 of FIG. 3.

FIG. 4 provides a transverse cross sectional view, taken along line 4—4 of FIG. 3. The elongated rectangular shank 39, secured to the shear blade, is received with a slight clearance within the interior of the rectangular guide tube 47. The perpendicularly disposed set screws 44 and 49 may be slightly adjusted to adjust the clearance between the interior walls of the guide tube 47 and the side faces of the rectangular shank 39. This allows extremely precise positioning of the arcuate shear blade. The rectangular guide tube 47 is secured, by welding, to the elongated support standard 48. The opposed side wall portions 65 and 54 are secured to the base 26, which has been partially cut away for purposes of illustration. The pivotal adjustment plate 55 is mounted for pivotal movement by the pivot bolt 53 to the base 26. The adjustable stop screw 50 extends through the mounting tab 52, jam nut 57 and beneath the bottom end of the rectangular guide 47.

Figure 5:
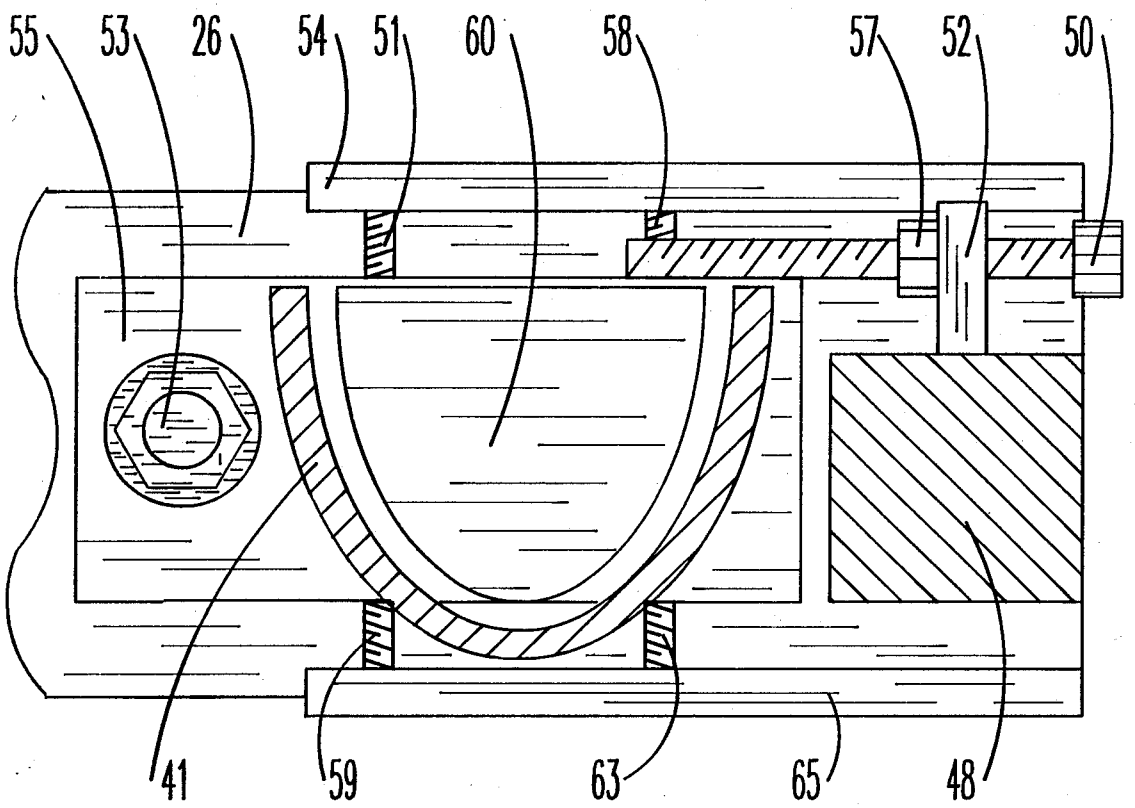
FIG. 5 is a transverse cross sectional view, taken along line 5—5 of FIG. 3.

FIG. 5 provides a cross sectional view, taken along line 5—5 of FIG. 3, which illustrates the arcuate configuration of the shear blade 41, disposed in alignment with the complementary configured anvil plate 60. The anvil plate 60 is rigidly secured on the upper surface of the pivotal adjustment plate 55. The set screws 51, 58 and opposed set screws 59 and 63 extend through respective side wall portions 54 and 65 secured to the base 26. By loosening the pivot bolt 53, and adjusting the set screws 51, 58, 59 and 63, the pivotal adjustment plate 55 may be rotated in either of two opposite rotational directions about the axis of the bolt 53, to precisely align the arcuate edge of the anvil plate 60, with the cutting edge of the shear blade 41. Upon adjustment of the edge of the anvil plate 60 to the desired orientation, the adjustment plate 55 is secured in the desired orientation by retightening the pivot bolt 53. The end of the stop screw 50 is disposed adjacent the anvil plate 60 and is adapted to abut a horseshoe blank supported thereon. This allows a horseshoe blank to be quickly aligned in the proper position on the anvil plate 60.

Figure 6:
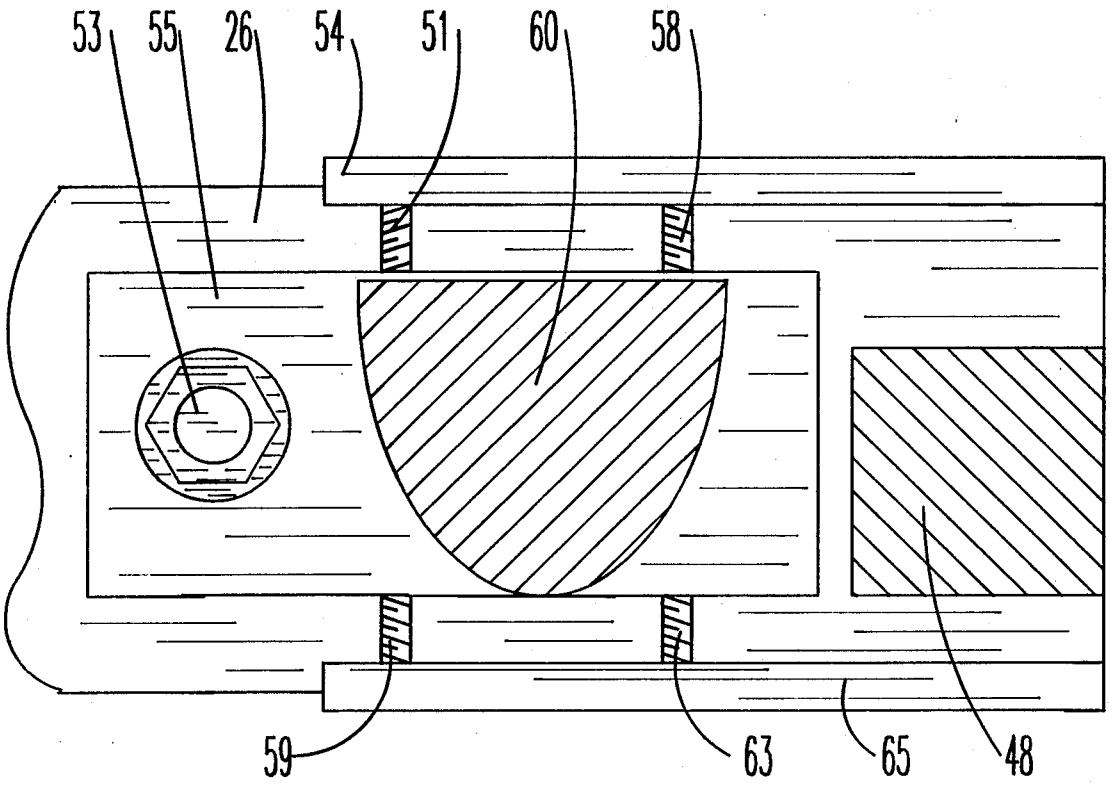
FIG. 6 is a transverse cross sectional view, taken along line 6—6 of FIG. 3.

FIG. 6 projects a transverse cross sectional view, taken along line 6—6 of FIG. 3, which further illustrates the configuration of the anvil plate 60 mounted on the pivotal adjustment plate 55.

Figure 7:
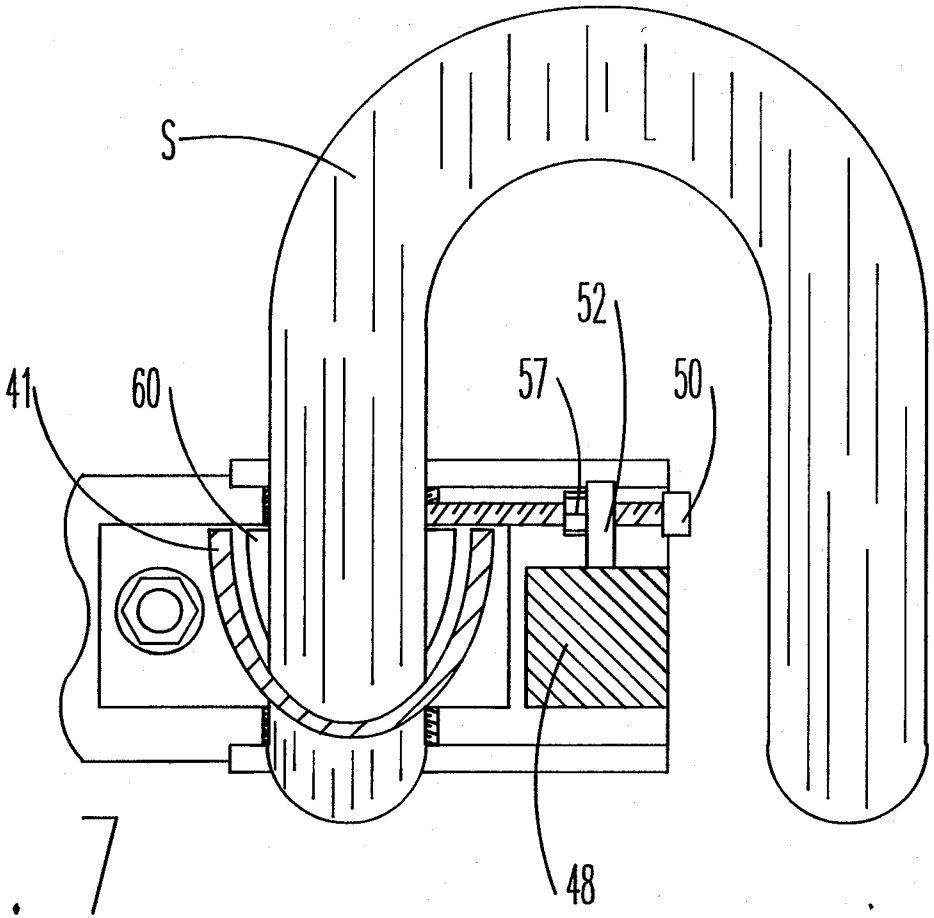
FIG. 7 is a transverse cross sectional view, similar to FIG. 5, illustrating the positioning of a horseshoe blank prior to a trimming operation.

FIG. 7 depicts a transverse cross sectional view, similar to FIG. 5, which illustrates the positioning of a horseshoe blank S on the anvil plate 60, in a position to have the arcuate free end severe by the shear blade 41. Note the abutment of the side edge of the blank S with the end of the stop screw 50. The opposite leg of the U-shaped blank S may be received around the supporting standard 48, as illustrated, or may be disposed to the left of the anvil plate 60, without interfering with the operation of the device. It is to be understood that the horseshoe blank S may be pre-heated and held by suitable pliers or tongs during the severing operation.

Figure 8:
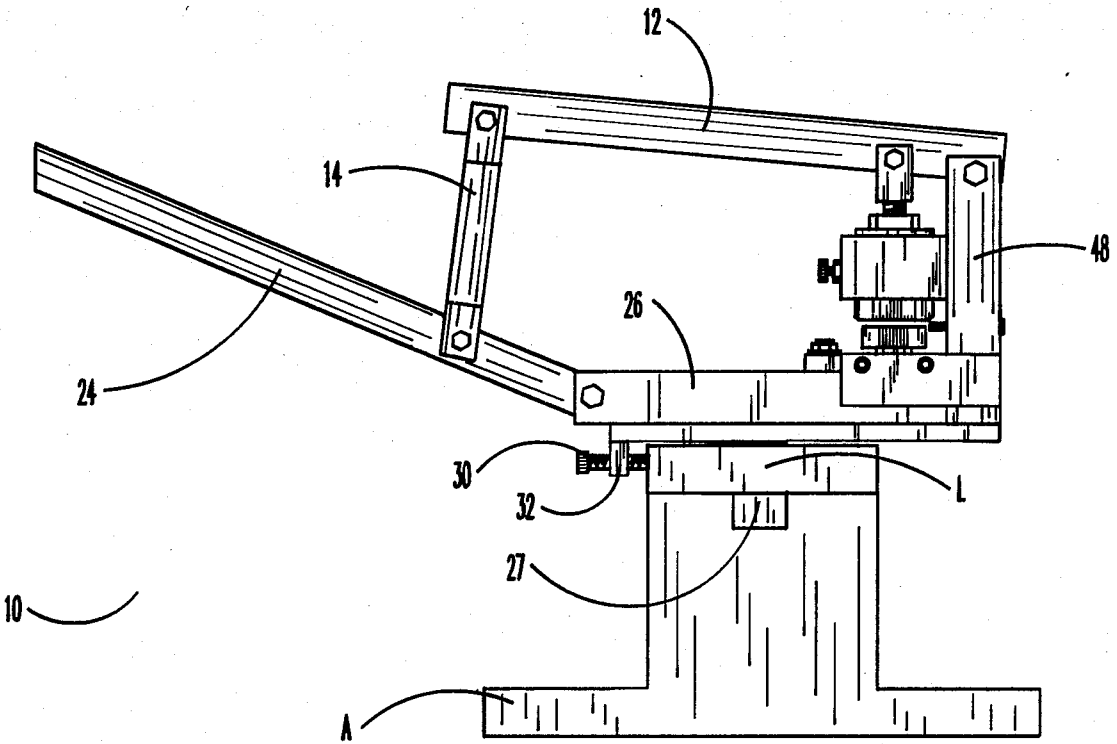
FIG. 8 is a side view illustrating the horseshoe trimming device of the present invention secured to a conventional farrier's anvil.

FIG. 8 depicts a side view of the horseshoe trimming device 10 of the present invention, mounted on a conventional farrier's anvil A. The mounting post 27 is received through a ledge portion L of the anvil A, through a conventionally provided rectangular socket. The clamping screw 30 engages a side wall portion of the ledge L of the anvil A and clamps a portion of the anvil A between the mounting post 27 and the clamp screw 30. The horseshoe trimming device 10 of the present invention does not interfere with the conventional forming operation of the horseshoe blank carried out by hammering the blank on the arcuate portion of the anvil. The trimming device 10 may be easily and quickly removed or attached to the anvil A, and is of a relatively light weight to enable convenient portability.

Figure 9:
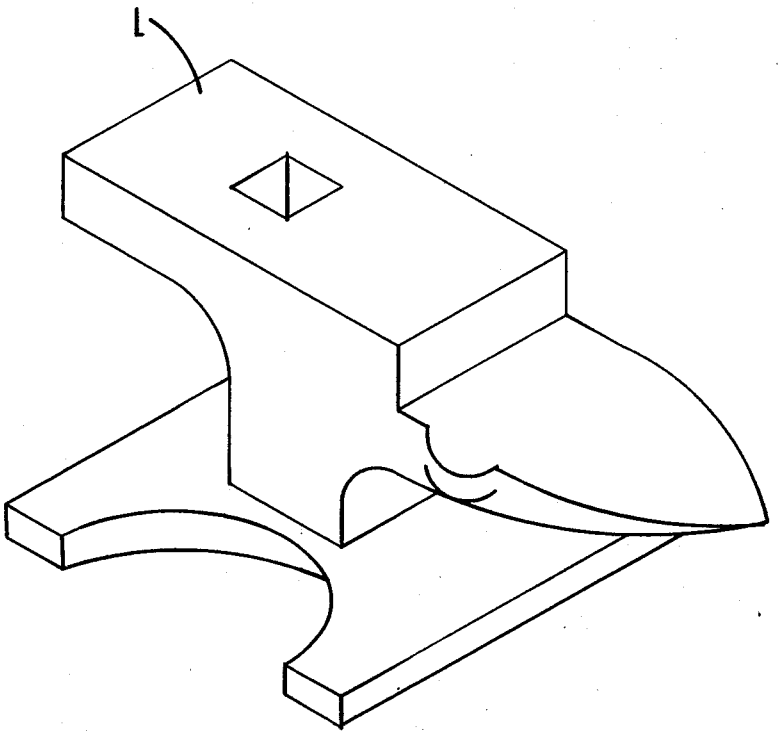
FIG. 9 (PRIOR ART)
FIG. 9 is a perspective view illustrating the general configuration of a conventional farrier's anvil.

FIG. 9 depicts a perspective view which illustrates the general configuration of a conventional farrier's anvil. The rectangular socket is located in the top ledge portion L of the anvil. The curved front portion of the anvil is utilized to form the horseshoe blank to the correct curvature, by repeated heating and hammering, as required.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed:

1. A horseshoe trimming device adapted for mounting on a farrier's anvil having a rectangular socket, comprising:

a base;

a rectangular mounting post extending downwardly from a bottom surface of said base and dimensioned for insertion into the rectangular socket on a farrier's anvil;

clamping means on said base for clamping a portion of the anvil against the mounting post;

an adjustment plate pivotally mounted on an upper surface of said base;

means for pivotally moving said adjustment plate in opposite rotational directions;

means for securing said adjustment plate in a selected position;

an anvil plate on said adjustment plate;

an upwardly extending support standard on said base;

a hollow guide secured to said support standard;

a shear blade having an elongated shank received with clearance for reciprocal linear movement within said guide, said shear blade disposed in alignment with an edge of said anvil plate;

means for adjusting the clearance of said shank with said guide in two perpendicular directions;

adjustable stop means on said standard for aligning a horseshoe on said anvil plate;

and a compound pivotal linkage for moving said shear blade.

2. The horseshoe trimming device of claim 1, further comprising means for adjustably securing said elongated shear blade shank to said pivotal linkage.

3. A horseshoe trimming device adapted for mounting on a farrier's anvil, having a rectangular socket, comprising:

base means;

means for securing said base means to a farrier's anvil;

cutting means secured to said base means;

an anvil plate secured to said base means for supporting a horseshoe in alignment with said cutting means;

means adjustably mounting said anvil plate on said base means;

and means for activating said cutting means.

4. The horseshoe trimming device of claim 3, further comprising means for securing said anvil plate in a selected adjusted position.

5. The horseshoe trimming device of claim 3, wherein said adjustable mounting means includes means pivotally mounting said anvil plate on said base means.

6. The horseshoe trimming device of claim 5, further comprising at least two opposed set screws for adjusting said anvil plate in opposite pivotal directions.

7. The horseshoe trimming device of claim 3, wherein said cutting means comprises a shear blade.

8. The horseshoe trimming device of claim 7, wherein said shear blade is arcuate.

9. A horseshoe trimming device adapted for mounting on a farrier's anvil, having a rectangular socket, comprising:

base means;

means for securing said base means to a farrier's anvil;

cutting means secured to said base means, said cutting means including a shear blade mounted for reciprocal linear movement;

means secured to said base means for supporting a horseshoe in alignment with said cutting means;

and a compound pivotal linkage operably connected for moving said shear blade.

10. The horseshoe trimming device of claim 9, further comprising a hollow guide;

said shear blade having an elongated shank received with clearance for reciprocal movement within said hollow guide;

and means for adjusting the clearance of said shank within said hollow guide in two perpendicular directions.

11. A horseshoe trimming device adapted for mounting on a farrier's anvil, having a rectangular socket, comprising:

base means;

an elongated rectangular post extending from a bottom surface of said base means and dimensioned for insertion into a complementary rectangular socket formed in the farrier's anvil;

clamping means on said base means for clamping a portion of the anvil against said post for securing said base means to the anvil;

cutting means secured to said base means;

means secured to said base means for supporting a horseshoe in alignment with said cutting means;

and means for activating said cutting means.

12. The horseshoe trimming device of claim 11, wherein said clamping means comprises a clamp screw.

13. A horseshoe trimming device adapted for mounting on a farrier's anvil, having a rectangular socket, comprising:

base means;

means for securing said base means to a farrier's anvil;

cutting means secured to said base means;

an anvil plate secured to said base means for supporting a horseshoe in alignment with said cutting means;

means for activating said cutting means;

and adjustable stop means for positioning a horseshoe on said anvil plate.

14. The horseshoe trimming device of claim 13, wherein said adjustable stop means comprises a stop screw.

15. The horseshoe trimming device of claim 13, further comprising adjustable mounting means pivotally mounting said anvil plate on said base means.

16. The horseshoe trimming device of claim 15, further comprising means for securing said anvil plate in a selected adjusted position.

17. The horseshoe trimming device of claim 15, further comprising at least two opposed set screws for adjusting said anvil plate in opposite pivotal directions.

18. The horseshoe trimming device of claim 13, wherein said cutting means comprises a shear blade.

19. The horseshoe trimming device of claim 18, wherein said shear blade is arcuate.

20. The horseshoe trimming device of claim 18, further comprising a compound pivotal linkage operably connected for moving said shear blade.

* * * * *